United States Patent [19]

Lange

[11] Patent Number: 4,593,841

[45] Date of Patent: Jun. 10, 1986

[54] PACK CART

[75] Inventor: Roland Lange, Port Arthur, Tex.

[73] Assignee: Underwater Design Technology Inc., Nederland, Tex.

[21] Appl. No.: 701,551

[22] Filed: Feb. 15, 1985

[51] Int. Cl.[4] ..... A45F 4/02

[52] U.S. Cl. ..... 224/153; 224/210; 224/261

[58] Field of Search ..... 224/153, 263, 261, 262, 224/210, 211, 212, 151; 280/47.34, 47.24, 47.27; 190/117, 127, 124; 383/907

[56] References Cited

U.S. PATENT DOCUMENTS

| | | | |
|---|---|---|---|
| D. 130,181 | 10/1941 | Hartsock | 224/263 |
| D. 187,026 | 1/1960 | Lambert | 280/47.24 X |
| 1,028,168 | 6/1912 | Williams | 190/127 |
| 2,319,127 | 5/1943 | Guenther et al. | 190/117 |
| 3,560,015 | 2/1971 | Tracy et al. | 224/153 |
| 3,777,498 | 12/1973 | Andrews et al. | 383/102 |

FOREIGN PATENT DOCUMENTS

| | | | |
|---|---|---|---|
| 2115275 | 9/1983 | United Kingdom | 224/151 |

*Primary Examiner*—Stephen Marcus
*Assistant Examiner*—David Voorhees
*Attorney, Agent, or Firm*—Neal J. Mosely

[57] ABSTRACT

A pack cart convertible for use as a cart for wheeling a load over the ground, for use as a back pack for carrying loads on the back, or for carrying loads by hand comprises a lightweight tubular cart frame having quickly removable wheels and adapted to have a pack bag secured thereon. The pack bag member may be releasably attached to the cart frame by fabric fasteners and further secured by strap members. A lightweight tubular bag frame may be carried within the bag member for maintaining the bag in a predetermined shape and allowing the bag to stand on end independently or when secured to the cart frame. The pack cart frame includes a flexible strap handle for pulling the cart behind the user and a pair of shoulder straps, one being provided with a quick release buckle for allowing the pack cart assembly to be easily installed and removed from the shoulder mounted carrying position. The wheels may be quickly removed from the cart frame and stored in the pack bag.

15 Claims, 9 Drawing Figures

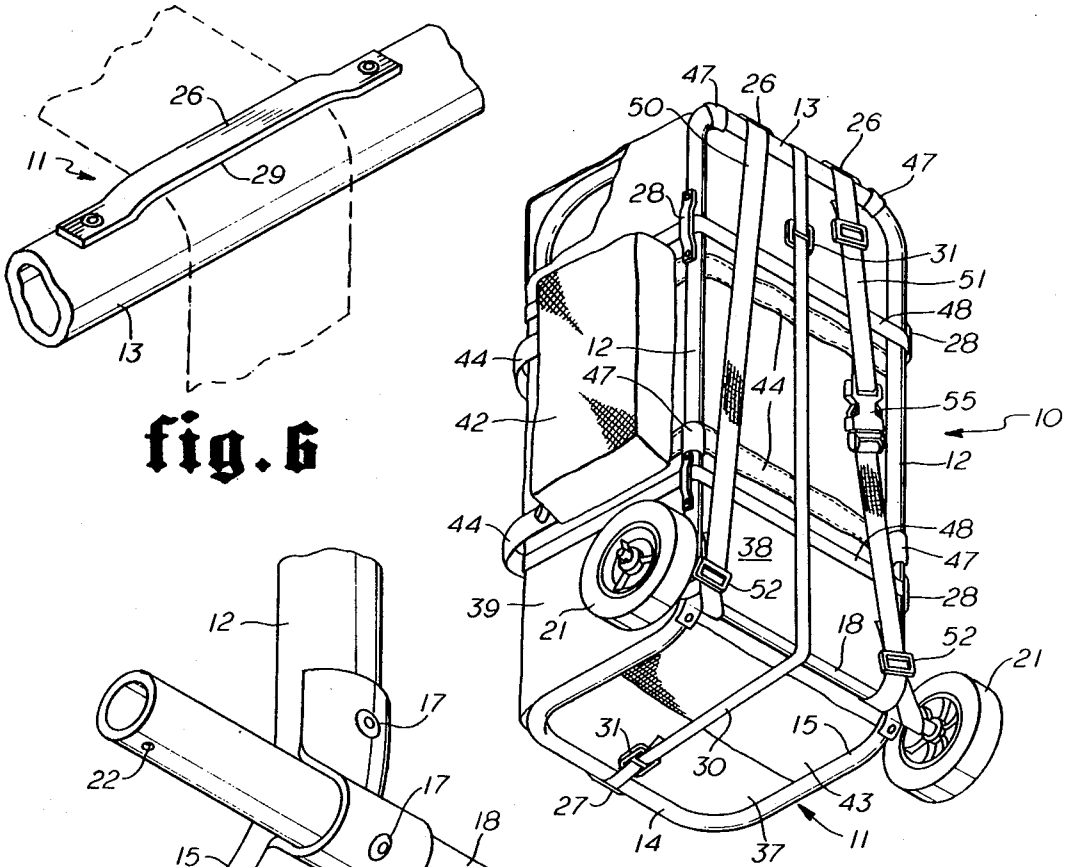
fig. 2
fig. 6
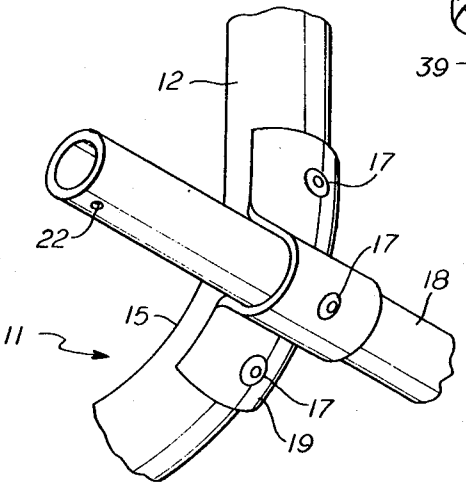
fig. 5
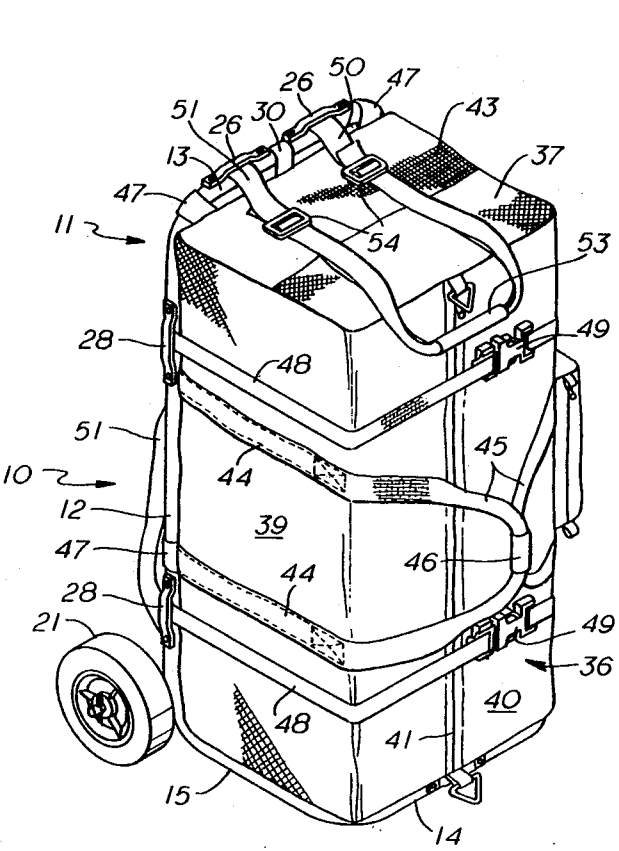
fig. 1

PACK CART

BACKGROUND OF THE INVENTION

1. Field of the Invention

This invention relates generally to back carriable carts and more particularly to a pack cart having novel frame, bag, and wheel construction.

2. Brief Description of the Prior Art

Carts which are adapted to be wheeled over the ground and converted for use as a back pack frame are known somewhat in the art. Many of these wheeled carts are provided with wheels immediately below the frame which may be locked against rotation, or pivoted so that they will not bear against the back of the carrier when used as a back pack. There are several patents which disclose various pack carts and back carriers.

Talbott, U.S. Pat. No. 2,401,986 discloses a pack cart adapted to be used as a cart for wheeling a pack over the ground or as a pack frame for carrying a pack on the back. A U-shaped axle bracket has its medial portion pivotally connected with the pack frame and carries wheels on outwardly protruding ends. The axle bracket is swingingly movable from one side to the other of the pack frame. Two struts have one end pivotally connected with the axle and their other end adapted to be detachably connected to the frame from either side of the pack frame.

Murphy, U.S. Pat. No. 4,368,835 discloses a back pack formed of spaced apart hollow tubular members open at their lower ends where each slidably receives a support shaft inserted thereinto. Wheels are mounted on axles extending outwardly from the shafts. A brake pin prevents the wheels from rotating when the back pack is stored in an upright position against a wall. Shoulder straps may also be secured to the frame by pins.

Nakatani, U.S. Pat. No. 4,362,307 discloses a shoulder carriable cart constructed of metal pipes wherein a pair of wheel supports are fitted over the frame in such a manner that they can either be rotated or held immovable by pins. The wheels may be set either on the front side of the frame, on the back side, or between the pipes of the frame.

The prior art in general, and none of these patents in particular, disclose the present pack cart having a lightweight tubular cart frame with removable wheels, a flexible towing handle, and a pack bag having a removable bag frame, and which is adapted to be received and secured on the cart frame.

SUMMARY OF THE INVENTION

It is therefore an object of the present invention to provide a new and improved pack cart which is capable of transporting heavy loads and gear and is easily and quickly convertible from a cart to a back pack frame.

It is another object of this invention to provide a pack cart offering the versatility of selectively transporting a load by pushing, pulling, hand carrying, or carrying on the back.

Another object of this invention is to provide a pack cart having a pair of wheels which can quickly and easily be removed and placed within the pack bag to render the pack cart suitable to be carried on the back as a back pack, or by hand similar to luggage, and which may be compactly stored.

A further object of this invention is to provide a pack cart which allows easy employment in a variety of diverse situations encountered by outdoorsmen and travelers such as checking gear in at airports, loading onto boats, and transporting over hazardous terrain.

A still further object of this invention is to provide an attractive pack cart which is constructed of corrosion resistant, lightweight material, is economical to manufacture, and rugged and durable in use.

Other objects of the invention will become apparent from time to time throughout the specification and claims as hereinafter related.

The above noted objects and other objects of the invention are accomplished by a pack cart convertible for use as a cart for wheeling a load over the ground, for use as a back pack for carrying loads on the back, or for carrying loads by hand.

BRIEF DESCRIPTION OF THE DRAWINGS

FIG. 1 is an isometric view showing the front, top, and one side of the cart in accordance with the present invention.

FIG. 2 is an isometric view showing the back, bottom, and the other side of the cart.

FIG. 5 is an isometric view of a portion of the frame of the cart showing the details of the wheel axle housing.

FIG. 6 is an isometric view of a portion of the frame of the cart showing the strap securing details.

DESCRIPTION OF THE PREFERRED EMBODIMENT

Figure 4:
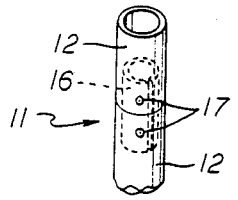
FIG. 4 is an isometric view illustrating the method of connecting the ends of the tubular frame members.

Referring now to the drawings by numerals of reference, there is shown a preferred pack cart 10. The pack cart frame 11 is formed of hollow plastic tubing such as PVC (polyvinyl chloride). The ends of the tubing are joined in a closed loop which is formed into a generally L-shape configuration having two parallel side rails 12 with cojoining transverse top rail 13 and bottom rail 14 portions, and an intermediate bent portion 15. As best seen in FIG. 4, the ends of the frame 11 along one side rail 12 are joined by securing a short cylindrical sleeve 16 into the opposing ends **12*a* and 12*b* by conventional fastening means such as rivets 17. The sleeve 16** is formed of a short section of PVC tubing split longitudinally along one side.

It should be noted that use of the PVC plastic provides a rugged lightweight frame having great strength which is resistant to corrosion and exposure to sunlight and other elements. This material also allows colors to be infused into the material to provide an attractive appearance.

A hollow tubular axle housing 18 of the same plastic material is secured transversely between the side rails 12 just above the bent portion 15 by brackets 19 (FIG. 5). Conventional fastening means such as rivets 17 secure the brackets 19 to the side rails 12 and the housing 18 within the brackets. The distal ends of the housing 18 extend a short distance outwardly of the brackets 19.

A straight axle rod 20 of suitable material such as aluminum is slidably, rotatably, and removably received within the axle housing 18 to carry a pair of wheels 21. Apertures 22 are provided through the axle rod 20 near each. An S-shaped retainer 23 is received through the aperture at one end and secured in place. One of the wheels 21 is inserted onto the axle rod 20, the axle rod is inserted into the housing 18, the other wheel is inserted onto the axle rod, and a quickly removable hairpin clip 24 is inserted into the aperture at the other end of the axle rod. A ring 25 carried on the clip 24 allows the user to quickly grasp and pull the clip from the aperture, eliminating the need for any tools to disassemble the wheels. In this manner, the wheels 21 are rotatably disposed on each side of the frame 11.

A pair of strap brackets 26 are conventionally secured in a spaced relation on the top rail 13, a single strap bracket 27 centrally secured on the bottom rail 14, and a pair of vertically spaced brackets 28 are secured to each side rail 12 in a horizontally aligned position. As seen in FIG. 6, the brackets 26, 27 and 28 have a central portion 29 which is raised from the tubular surface sufficient to receive a strap therethrough.

The preferred strap material is polypropylene webbing. A centrally disposed frame strap 30 extends downwardly from the top rail 13, over the axle housing 18, outwardly therefrom, and through the bracket 27 on the bottom rail 14. Each end of the strap 30 is looped over the appropriate top or bottom rail and adjustably secured on itself by plastic adjustment slides 31. The strap 30 may be adjusted to comfortably fit the back of the user when the pack cart is used as a back pack.

Figure 3:
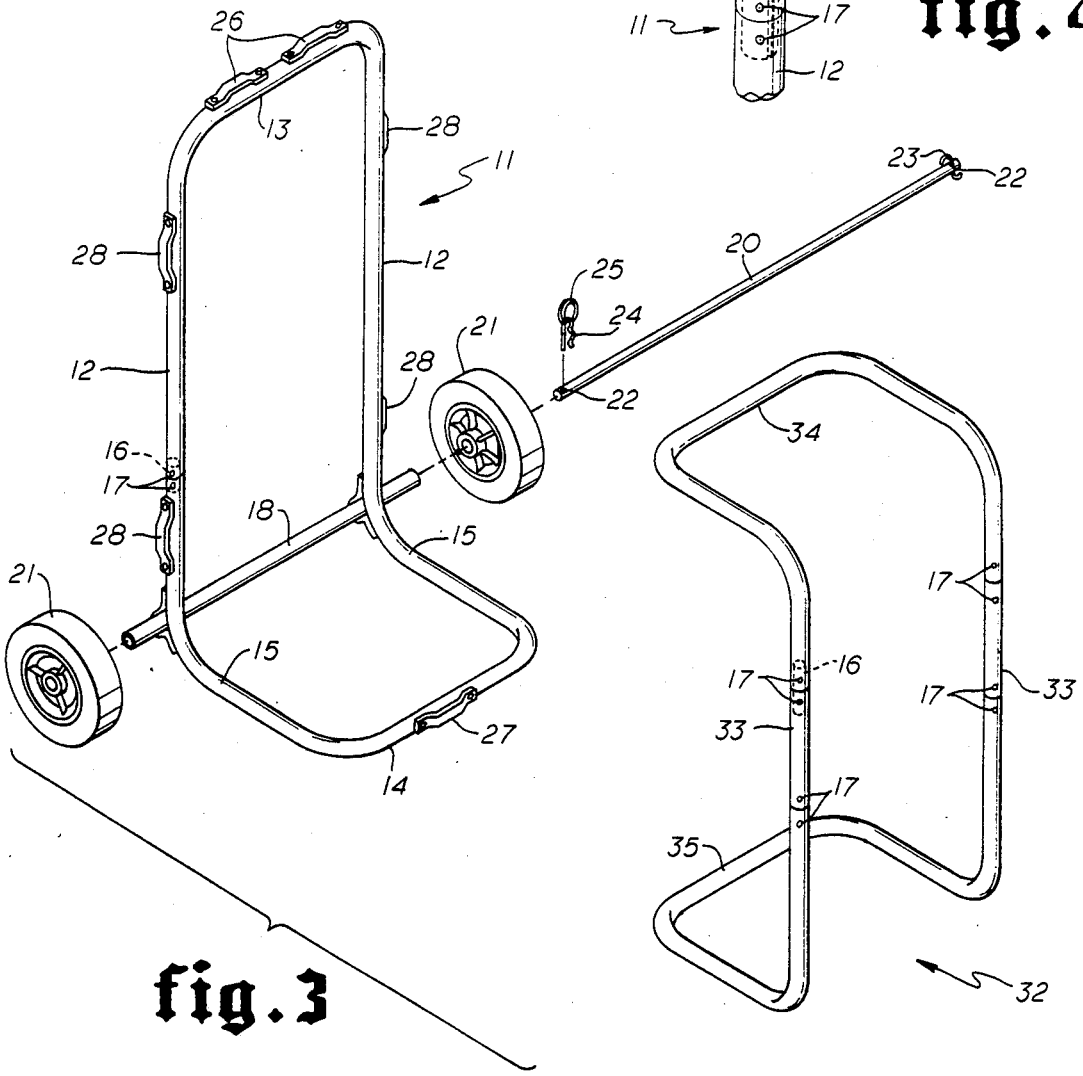
FIG. 3 is an exploded isometric view of the components of the cart frame.

As shown in FIG. 3, a second hollow tubular plastic frame 32 constructed in the same closed loop fashion as frame 11 is provided for use in the pack or gear bag member as described hereinafter. Frame 32 is formed into a generally rectangular C-shape configuration having two parallel side rails 33 with connecting transverse top rail 34 and bottom rail 35 portions extending perpendicularly therefrom. The top and bottom rail portions 34 and 35 are connected to the side rails 33 by securing short cylindrical sleeves 16 (previously described) into each end of the side rails and the opposing ends of the top and bottom rails.

The width of both frames 11 and 32 are substantially the same. When inserted within the gear bag 36, the side rails 33 of the bag frame 32 extend along the top edge of the side walls of the bag substantially the entire length and the looped rails 34 and 35 follow the edges of each end wall to maintain the bag shape and prevent it from collapsing when empty. This feature provides very easy packing and unpacking. The frame 32 also allows the bag to sit on a horizontal position or to stand up on end independently or when secured to the cart frame.

The gear or pack bag 36 is fashioned of a durable material such as Corduroy fabric into a generally rectangular shape having opposingend walls 37 cojoined by a bottom portion 38, side portions 39 and a top portion 40. The top portion is opened and closed by a longitudinally disposed zipper 41. A storage pouch 42 may be provided on at least one side portion. Vinyl coated mesh panels 43 may be provided on the end walls 37 which allow wet articles to continue drying while being transported.

A pair of looped polypropylene straps 44 secured to the bottom 38 and side portions of the bag 39 extend beyond the top portion 40 and the looped portions 45 may be joined together by a Velcro fastener 46 to serve as a handle for hand carrying the bag as a piece of luggage. Velcro loops 47 are provided at the top corners of the bottom portion of the bag 36 and near the opposing end wall. The Velcro loops 47 are looped around the side rails 12 and top rails 13 to attach the bag 36 to the frame 11.

A pair of polypropylene attaching straps 48 extend between the side rails 12 through brackets 28, and over the side portions 39 and top portion 40 of the bag 36. Adjustable quick release plastic buckles 49 at the ends of the straps 48 allow the bag 36 to be securely strapped to the frame 11. Two large shoulder straps 50 and 51 are looped around the intersection of the side rails with the axle housing with adjustment slides 52 and extend upwardly therefrom through the brackets 26 on the top rail 13.

The extended ends of the shoulder straps 50 and 51 form a loop above the top rail 13 which extends through a small section of PVC tubing forming a handle 53 and the ends of the straps are provided with adjustment slides 54. The flexible strap and handle arrangement allows the pack cart with wheels installed to be pulled or towed over ground by the user. One of the shoulder straps 51 is provided with a plastic quick release buckle 55 which allows the pack cart assembly to be easily installed and removed from the shoulder mounted carrying position.

OPERATION

It should be understood that the pack bag 36 may be removed from the frame 11, and the frame used independently as a cart, however, the following description assumes that the pack bag is secured to the frame as previously described.

Figure 7:
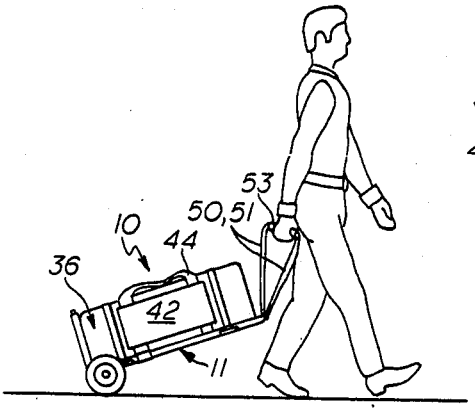

When the pack cart 10 is used as a cart, as shown in FIG. 7, the user simply holds onto the handle 53 at the looped top portion of the shoulder straps 50 and 51 and pulls the cart behind him. Because of the flexibility of the strap type towing handle, the wheels roll smoothly and negotiate bumps and sidewalk curbs easily.

Figure 8:
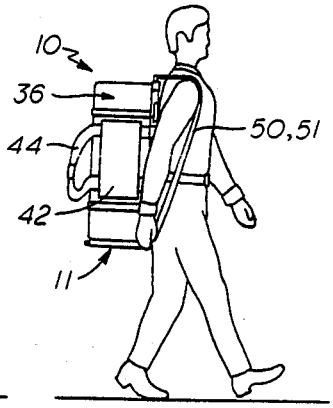

When the pack cart 10 is carried on the shoulders as a back pack as shown in FIG. 8, the user simply removes the hairpin retaining clip 24 from the wheel axle 20 and slides the wheel 21 adjacent the clip off of the axle. The axle and remaining wheel are then pulled out of the axle housing 18. The first removed wheel may be inserted back on the axle and the clip reinstalled thereon. In this manner, the wheel assembly is always together to prevent the components from being misplaced or lost. The wheel assembly can then be stored inside the pack bag 36. If storage space is at a premium, both wheels may be removed from the axle to occupy less space. The axle could be stored in the bag 36 and the wheels stored in the side pocket 42.

After the wheels are removed, and the shoulder straps 50 and 51 have been adjusted to a comfortable position, the pack cart 10 may be placed upright and will stand alone due to support of the bag frame 32. In this manner, the user may easily slip the shoulder straps over the shoulders and then fasten the buckle on the loose strap.

Figure 9:
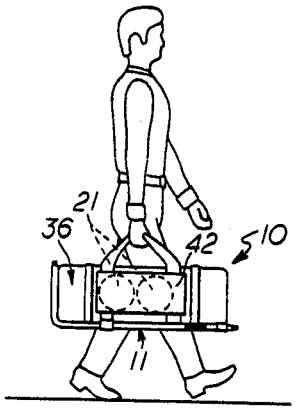
FIGS. 7, 8, and 9 are elevational views illustrating how the cart may be transported by the user.

The pack cart 10 with wheels installed or removed as shown in FIG. 9, may also be carried by hand in the manner of luggage or a suitcase by joining the looped nylon straps 44 extending from the side portions of the bag with the Velcro fastener to serve as a handle for transporting the pack cart. The bag frame 32 inside the bag 36 maintains the shape of the bag, and allows the bag to sit in a horizontal position or to stand up on end.

While this invention has been described fully and completely with special emphasis upon a preferred embodiment, it should be understood that within the scope of the appended claims the invention may be practiced otherwise than as specifically described herein.

I claim:

1. A pack cart carrying means convertible for use as a cart for wheeling a load over the ground, for use as a back pack for carrying loads on the back, or for carrying loads by hand comprising:

a tubular frame comprising a closed loop generally L-shaped configuration having two parallel L-shaped tubular side rails with connecting transverse tubular top rail and tubular bottom rail portions extending perpendicularly between said side rails and adapted to have a pack secured within said L-shaped configuration, a pair of strap brackets secured in a spaced relation on said top rail, a single strap bracket centrally secured on said bottom rail, and a pair of vertically spaced strap brackets secured to each side rail in a horizontally aligned position, said strap brackets having a central portion which is raised from the tubular surface sufficient to receive a strap therethrough, a centrally disposed frame strap extending downwardly from said top rail, over said axle housing, outwardly therefrom, and through the said strap bracket on said bottom rail, each end of the strap being looped over said top and bottom rail and adjustably secured on itself by adjustment slides, a hollow tubular axle housing member secured to said frame transversely between said side rails, an axle member removably and rotatably received within said axle housing, a pair of wheels rotatably and removably carried on opposite ends of said axle member, and quick release retaining means carried on said axle member for selectively removing and installing said wheels thereon, two shoulder straps each looped around the intersection of said side rails with said axle housing with adjustment slides and extending upwardly therefrom through said strap brackets on said top rail, the extended ends of the shoulder straps being joined to form a loop above said top rail with a small section of tubing supported thereon to form a handle for pulling the pack cart when pulled to an extended position, one of said shoulder straps provided with a quick release buckle for allowing the pack cart assembly to be easily installed and removed from the shouldr mounted carrying position, said shoulder straps being of sufficient length when pulled out to a point where said handle is adjacent to said top rail brackets to support said cart on the shoulders and back of the user, and when the handle is pulled to a fully extended position to provide a length of said straps sufficient for pulling said cart along the ground, with the wheels installed, a hollow tubular axle housing member secured to said frame transversely between said side rails, an axle member removably and rotatably received within said axle housing, wheels rotatably and removably carried on said axle member, and quick release retaining means carried on said axle member for selectively removing and installing said wheels thereon.

2. A pack cart according to claim 1 in which said cart frame is formed of plastic tubing the ends of which are joined together by a short cylindrical sleeve secured within the opposing ends.

3. A pack cart according to claim 2 in which said cart frame plastic tubing is colored by infusing color pigments into the plastic material.

4. A pack cart according to claim 1 in which said axle member comprises a straight rod having apertures therethrough near each end, an S-shaped retainer secured through the aperture at one end and a cotter pin releasably carried in the aperture at the other end of said axle member.

5. A pack cart according to claim 1 further including a pack bag member releasably secured on said tubular frame and having supporting straps thereon for lifting said pack bag member and frame together.

6. A pack cart according to claim 5 in which said pack bag member is provided with releasable fabric fasteners for securing said bag to said cart frame.

7. A pack cart according to claim 6 in which said pack bag member includes a bag frame of tubular plastic removably received therein for maintaining said bag in a predetermined shape and allowing said bag to sit in a horizontal position or to stand on end independently or when secured to said cart frame.

8. A pack cart according to claim 7 in which said bag frame forms a closed loop of tubular plastic, generally rectangular C-shape configuration having two parallel side rails with cojoining transversre top rail and bottom rail portions extending perpendicularly therefrom, said side rails when said bag frame is inserted within said bag extending along the top edge of the side walls substantially the entire length thereof and said top and bottom rails following the edges of each end wall thereof and cooperating with said pack cart frame to maintain the shape of said bag shape and prevent it from collapsing when empty.

9. A pack cart according to claim 8 in which said bag frame tubular plastic has abutting ends joined together by a short cylindrical sleeve secured therein.

10. A pack cart according to claim 9 in which said bag frame plastic tubing is colored by infusing color pigments into the plastic material.

11. A pack cart according to claim 5 in which said pack bag member has a generally rectangular shape of fabric or plastic sheet with opposing end walls cojoined by a bottom portion, side portions, and a top portion, said top portion having an opening provided with a zipper.

12. A pack cart according to claim 11 in which said pack bag member includes a pair of looped polypropylene straps secured to said bottom and side portions and extending beyond said top portion, one of said straps carrying a releasable fabric fastener joining the looped portions together as a handle for hand carrying said bag as a piece of luggage independently or when secured to said cart frame.

13. A pack cart according to claim 12 in which said cart frame includes a pair of attaching straps extending between said side rails and through said side rail strap brackets, and over said side portions and top portion of said bag, and adjustable quick release buckles on each of said straps releasably securing said bag to said frame.

14. A pack cart according to claim 11 in which at least one end wall of said pack bag has a vinyl coated panel for exposing wet articles within said bag to air to allow drying of the articles while being transported.

15. A pack cart according to claim 11 in which said pack bag includes at least one storage pouch secured on at least one said side portion.

* * * * *